United States Patent [19]

Cassady

[11] Patent Number: 4,974,323

[45] Date of Patent: Dec. 4, 1990

[54] COHERENT CONTROL DEVICE FOR FOLDING KNIFE, TOOL, ETC.

[76] Inventor: William E. Cassady, P.O. Box 723, San Anselmo, Calif. 94960

[21] Appl. No.: 217,688

[22] Filed: Jul. 11, 1988

[51] Int. Cl.[5] ..... B26B 1/00

[52] U.S. Cl. ..... 30/155; 30/156; 30/158; 30/160

[58] Field of Search ..... 30/155, 156, 158, 159, 30/160, 161

[56] References Cited

U.S. PATENT DOCUMENTS

| | | | |
|---|---|---|---|
| 23,975 | 5/1859 | Belcher | 30/160 |
| 543,943 | 8/1895 | Minter | 30/160 |
| 553,430 | 1/1896 | Schmachtenberg | 30/158 |
| 689,513 | 12/1900 | Papendell | 30/158 |
| 943,990 | 12/1909 | Nell | 30/159 |
| 947,980 | 2/1910 | Romano | 30/153 |
| 996,231 | 6/1911 | Evens | 30/161 |
| 1,168,633 | 1/1916 | Heywood | 30/156 |
| 1,319,532 | 10/1919 | Rasmussen | 30/159 |
| 1,478,260 | 12/1922 | Sibley | 30/157 |
| 1,743,022 | 1/1930 | Carman | 30/161 |
| 3,002,273 | 10/1961 | Merrit | 30/2 |
| 4,612,706 | 9/1986 | Yunes | 30/160 |

FOREIGN PATENT DOCUMENTS

| | | | |
|---|---|---|---|
| 1104386 | 4/1961 | Fed. Rep. of Germany | 30/158 |
| 25140 | 2/1903 | United Kingdom | 30/159 |

OTHER PUBLICATIONS

Peterson (pub.) "Petersen's Complete Book of Knives", 1988, pp. 18–23, "25 Yrs. of Lock-Back Folders", Steve Shackleford.

*Primary Examiner*—Frank T. Yost
*Assistant Examiner*—Hwei-Siu Payer

[57] ABSTRACT

In a folding knife or tool having a handle and a blade pivotally connected to the handle, a control plate 28 slides in a shaped cavity 52 between handle plates 46,68, and swings, and also swings on, a crankpin 24 attached to the blade tang, and embodies a cam surface 36 at the distal end. A stem portion 30 of the control plate 28 protrudes to the surface of the handle whereby it may be manipulated by the user to cause the blade to open or close, and then to cause the cam surface 36 to engage a ramp 62 and spur 60 to thereby interpose a mechanical block to reverse blade rotation. Further pressure upon the stem 30 will then remove running clearances, tightening the blade solidly against wobble, and the control plate 28 against dislodgement.

1 Claim, 2 Drawing Sheets

Figure 1:
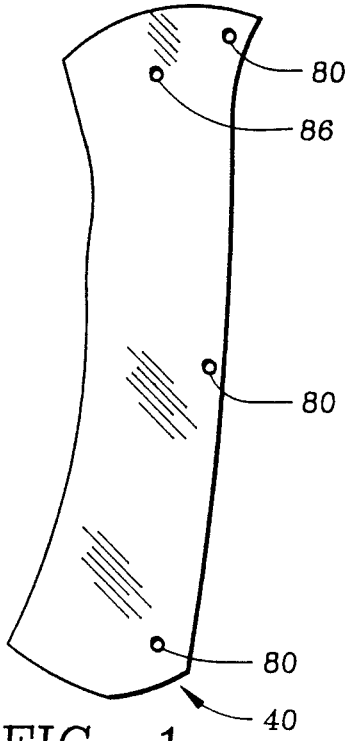

COHERENT CONTROL DEVICE FOR FOLDING KNIFE, TOOL, ETC.

BACKGROUND—FIELD OF INVENTION

This invention relates to folding hand tools in which a blade or working member pivots into an enclosing protective sheath which forms a handle when the tool is in use, especially pocket knives, and specifically to an improved device for moving and locking the blade.

BACKGROUND—DISCUSSION OF PRIOR ART

Upon the invention of the blade arose the twin problems of how to attach a handle so the blade may be effectively deployed, and how to carry it safe from injury. The invention of the folding knife combined sheath and handle, providing a considerable advantage of compactness and convenience of carry along with a safety advantage: in a fall, the user was less likely to be injured bearing a folded knife than carrying or wearing a sheath knife. These advantages came at the expense of several interrelated disadvantages:

(a) Difficulty of deployment. The insertion of a fingernail or pinch grip on the blade edge and subsequent manipulation of the blade into open position was difficult at best. If the hands were gloved, or cold, wet or slippery, blade extraction against the pressure of a backspring was infeasible.

(b) Two hands were required to open the blade. In contrast to the sheath knife, if one hand were unavailable, the remaining hand could not open the blade unassisted.

(c) Strength of blade attachment. Blades were attached to handles by a single pivot, which, in conjunction with whatever handle portion served to limit their extent of opening, bore the entire working stress of the blade. Moreover, backspring and backlocking mechanisms preclude the use of through pins or rivets in the area of the pivot to maximize the rigidity of the pivot area since this is precisely the area the spring or lock lever needs to move in.

(d) Blade wobble. Related to the previous factor. Manufacturing allowances must be provided so that parts can move freely. But this results in mechanical looseness. If backspring tension were removed the blade would be seen to have lateral movement along the pin between the sides and twist and back and forth movement caused by slack in the pivot. Manufacturers reduce perceived wobble by increasing backspring pressure. This makes knives hard to open.

(e) Blade security. Many persons felt that even the heaviest backspring pressure feasible to allow opening was insufficient to insure against accidental collapse of the blade and consequent possible injury to the hand. Many different types of blade locking devices and knife designs in which the blade is positively blocked against accidental closure have been designed. They inevitably gain security at the expense of convenience or strength or wobble.

Some efforts to minimize or overcome these disadvantages are of particular interest:

Belcher, U.S. Pat. No. 23,975 (1859) and many similar designs, some still in use, used pins offset from the blade pivot which engaged arcurate slots in the handles such that the handles could be counter-rotated with respect to one another thus carrying the blade to its open or closed position. This design avoided the backspring altogether but was cumbersome and difficult to latch. The design lacks rigidity in that the only connection between the two handles and the blade is the single pivot pin.

Minter, U.S. Pat. No. 543,943 (1895), offered an extensible lever fulcrumed on the pivot pin . One did not have to touch the blade with the fingers and the blade locked open against the backspring. Whether the buying public could not accustom itself to the lever dragging along the sharp edge of the blade, or whether the lever dangled forth in the pocket at inopportune times, the design did not achieve notable success in this country.

Schmachtenberg, U.S. Pat. No. 553,430 (1896), likewise objected to touching the blade to extract it from closed position. He designed a simple teeter-totter lever , projecting through the handle at one end to pry the blade forth against the pressure of the backspring. After the blade is dislodged it must be carried to the fullY opened position by the fingers, as he says. There is no provision to close or lock the blade.

Papendell, U.S. Pat. No. 689,513 (1900), like Minter, used a foreward projecting lever to pry open the blade. However, he avoided the lever contacting the blade edge by bearing it against a projecting lug, and prevented the untimely deployment of the lever by the expedient of pivoting it on the blade pivot; thereby sacrificing the locking function devised by Minter.

In a side development, Romano, U.S. Pat. No. 947,980 (1910), used offset pins and arms attached thereto to fold a portion of the handle closed when the blade was opened and vice versa. His objective was to allow a folding blade longer than the handle.

Sibley, U.S. Pat. No. 1,478,260 (1922), used a slide arranged to pull a link to pull an offset pin to pull the blade open. The slide then snapped into a detent in the handle, locking the blade. The process was reversed to close the blade. Perhaps complexity of design, a multiplicity of small parts, cumulative slack in the mechanical train, or economic factors prevented widespread success of this singular attempt to provide all blade control functions with one hand. What is certain is that spring pressure was directed only toward keeping the slide in its fixed detent and not toward pulling the slide against the blade to remove the slack in the actuating system.

Yunes, U.S. Pat. No. 4,612,706 (1986), addressed the problem of blade wobble. He used offset pins and arms as had Romano earlier, but with a toggle on the butt of the handle to firmly cinch the blade. The design requires two hands to operate, and numerous parts of extraordinary precision to manufacture.

The elusive goal of effective one hand blade control seems to have been abandoned since Sibley. Recently proposed and implemented designs for belt sheaths which hold folding knives in partially folded condition and which extend the blade as the knife is withdrawn seem to imply this.

Most users, therefore, would find it desireable to have a knife embodying means, at once simple and effective, of coherent and unified one hand control of blade movement and locking, and of removing mechanical slack to achieve a solid, strong and rigid working structure.

OBJECTS AND ADVANTAGES

Accordingly, I claim the following as the objects and advantages of my invention:

To provide a folding knife in which it is unnecessary to touch the blade in order to open it, and in which external projections on the exposed portion of the blade or concavities designed to be caught by the finger or fingernail are avoided; to provide such a knife that it may be operated by a single hand even when the hands may be cold, wet, slippery or protected by gloves; to provide such a knife in which all blade control functions are integrated in the coherent movement of a control plate with a control surface conveniently available to the guidance of the finger.

To provide a folding knife which may be easily and conveniently unlatched from a closed and locked condition while held in the hand, by the manipulation of a control surface by the thumb and/ or fingers of the same hand; to provide that the blade of such knife may be fully extended under full control of the user by a further progressive manipulation of the control surface without the assistance of the other hand, springs, gravity or inertia; to further provide that the blade of such knife may be securely locked in the fully extended position by further pressure upon the control surface; to provide that the blade may be easily and conveniently unlocked from its extended and locked condition by a reverse manipulation of the same control surface by the same thumb and/or fingers; to provide that the blade may be returned to the closed folded position by a further manipulation of the control surface and without the assistance of the other hand, nor the necessity of contact with other body parts nor external objects; to further provide that the blade may be securely locked in the folded closed condition by a manipulation of the control surface by the single hand.

To provide such a folding knife in which the blade locking function, in addition to interposing a mechanical block to unwanted reverse blade rotation, will impose progressive elastic tension between blade and handle to remove residual mechanical slack and provide a solid, rigid and secure working structure and a safely pocketable carrying structure.

To provide a folding knife of superior strength and durability by the avoidance of backspring, leaf or notch locking elements working along the spine, or center locking devices using small parts, common to existing designs, and by instead providing a single spine member attached securely near the blade pivot, and blade control functions contained within or associated with plates which form the handle and which additionally strengthen such knife.

To provide that the blade, in its extended and locked position, will be supported at three points—one on either side of the blade pivot.

To provide that such objects and advantages as mentioned herein and others that may become apparent be accomplished with simplicity and economy of means so that instead of a multiplicity of diverse parts, functions and locations necessary to operate the blade, as common to existing designs, total blade control function may be provided on such a knife with as few as one moving part: the blade control plate sliding on its pivot.

To provide a knife in which the blade control mechanism and its associated movement is arranged in a coherent and unitary fashion: mechanically logical, intuitively understandable, and which most users would find to be palpably cogent.

Readers will find further objects and advantages of the invention from a consideration of the ensuing description and the accompanying drawings.

DRAWING FIGURES

Figure 2:
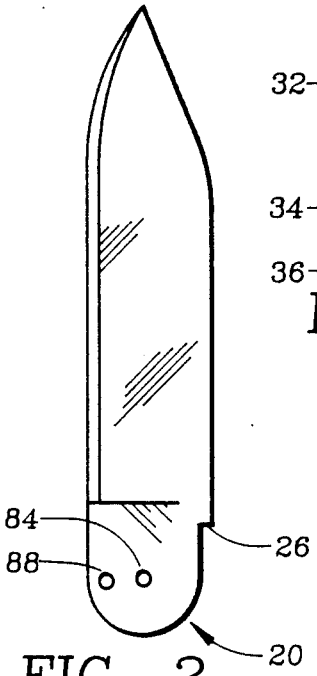
Figure 6:
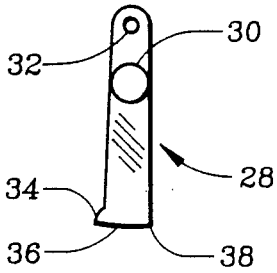
Figure 7:
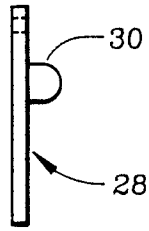
Figure 8:
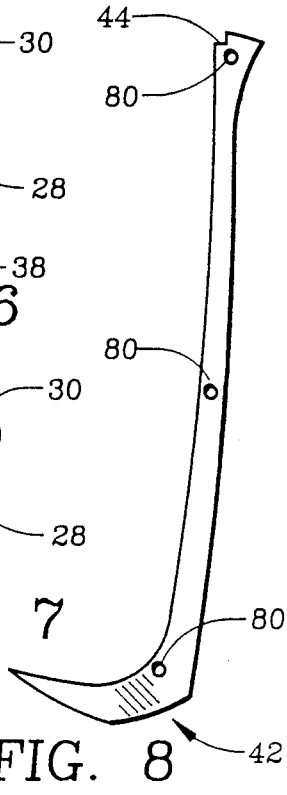
Figure 3:
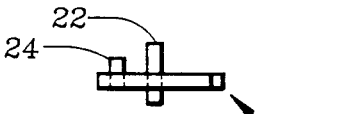
Figure 4:
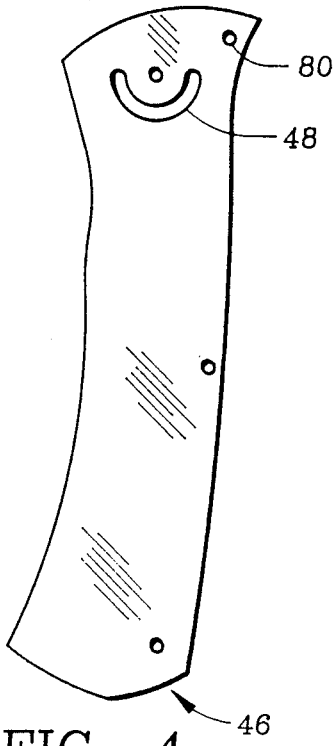
Figure 5:
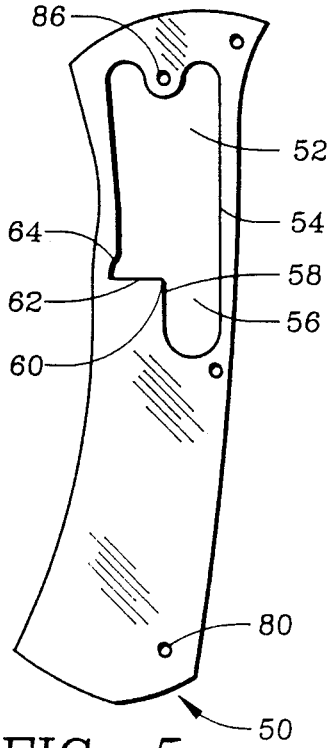
Figure 9:
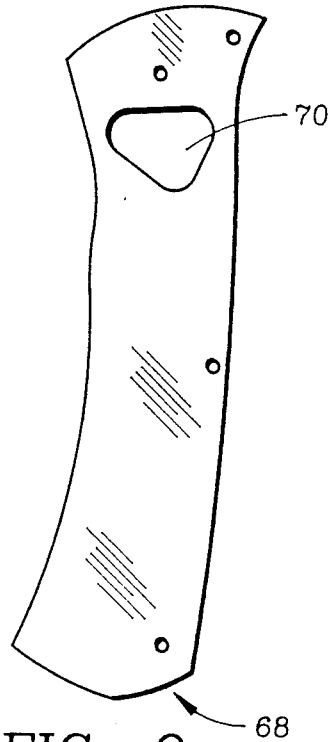
Figures 10, 11, 12, 13, 14, 15:
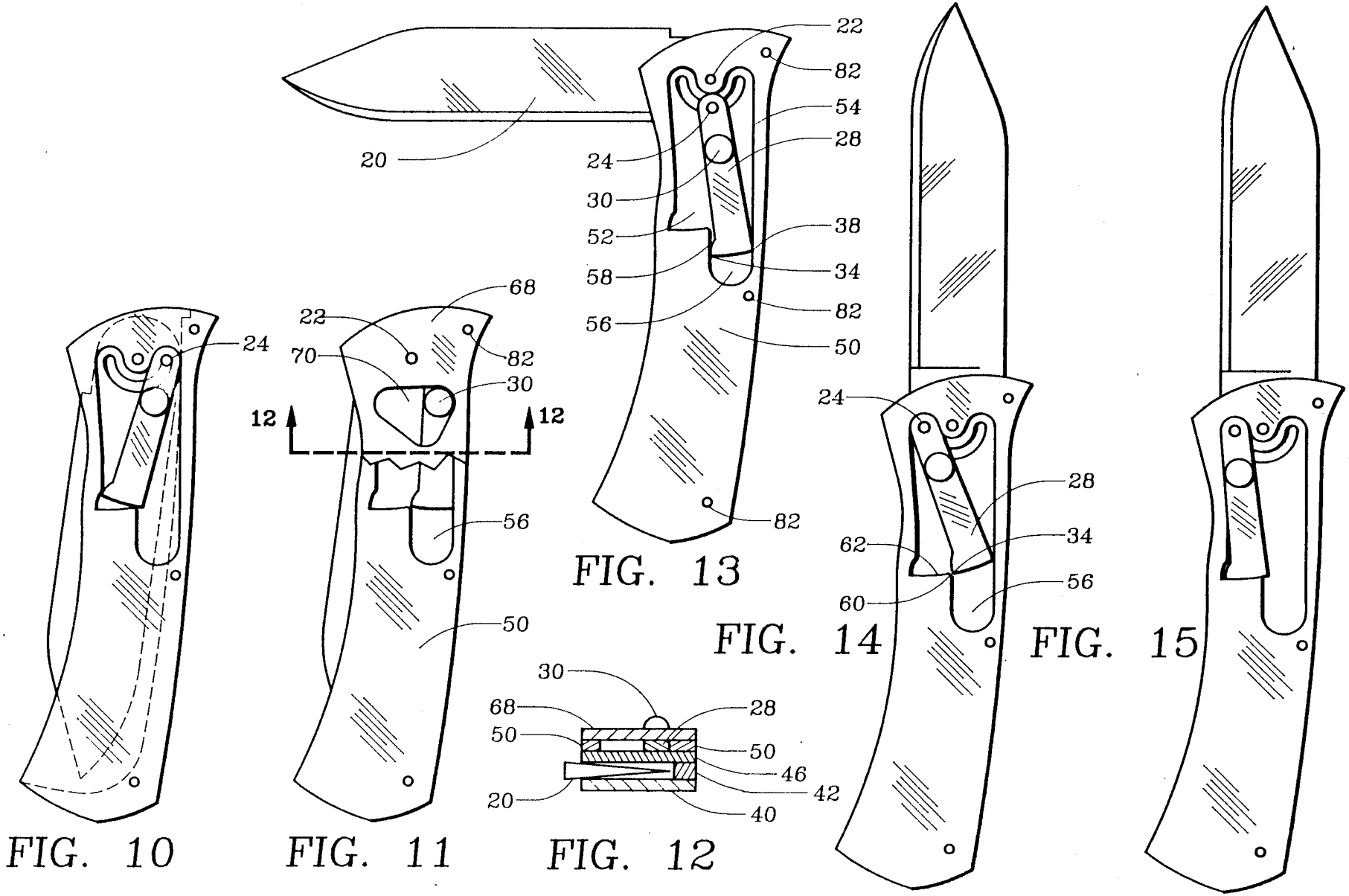

FIG. 1 shows a top view of the back plate of the knife according to the invention. FIG. 2 shows a top view of the blade. FIG. 3 shows an end view of the blade with the blade pivot pin and the crankpin installed. FIG. 4 shows a top view of the front plate. FIG. 5 shows a top view of the engagement plate. FIG. 6 shows a top view of the control plate FIG. 7 shows a side view of the control plate. FIG. 8 shows a top view of the spine. FIG. 9 shows a top view of the cover plate. FIG. 10 shows a top view of the knife in the closed and locked position. FIG. 11 shows a top view of the knife in the closed and unlocked position and with a partial cover plate installed. FIG. 12 shows a sectional view of the knife taken along the section line indicated on FIG. 11. FIG. 13 shows a top view of the knife in half open position. FIG. 14 shows a top view of the knife with blade fully extended. FIG. 15 shows a top view of the knife with the blade locked open.

LIST OF REFERENCE NUMERALS

20: blade
22: blade pivot pin
24: crankpin
26: blade stop notch on 20
28: control plate
30: finger stem, on 28
32: crankpin bore, on 28
34: toe, of 28
36: cam surface, of 28
38: heel, of 28
40: back plate
42: spine
44: spine stop notch
46: front plate
48: crankpin slot, in 46
50: engagement plate
52: shaped cavity, in 50
54: east guide surface, on 50, 52
56: bypass slot, on 50, in 52
58: west guide surface, on 50, in 52
60: engagement spur, on 50, in 52
62: engagement ramp, on 50, in 52
64: stop ridge, on 50, in 52
68: cover plate
70: finger stem hole, in 68
80: assembly pin holes, all handle plates and spine 42
82: assembly pins
84: blade pivot pin bore, in 20
86: blade pivot pin bore, all handle plates
88: crankpin bore, in 20

PIVOT BLADE KNIFE—DESCRIPTION

FIG. 1 shows the backplate 40 with its blade pivot pin bore 86, and assembly pin holes 80. Upon the backplate 40, the spine 42 shown in FIG. 8 is mounted so that the assembly pin holes 80 are in alignment. The blade 20 shown in FIG. 2, along with the blade pivot pin 22 and crankpin 24, as shown in FIG. 3, is mounted upon the backplate 40 so that the crankpin 24 is flush with the side of the blade 20 on the side contacting the backplate 40, and extending on the side opposite the backplate 40 for a purpose to be described. The blade pivot pin 22 protrudes through the backplate 40 until it is flush with the far side, or farther for option to be described. Frontplate 46, shown in FIG. 4, is mounted over the parts just described so that the assembly pin holes 80 align, and the blade pivot pin 22 protrudes through pivot pin bore 86 and the crankpin 24 protrudes through arcurate crankpin slot 48 in frontplate 46. Engagement plate 50, shown in FIG. 5, is mounted upon the front plate 46 so that blade pivot pin 22 protrudes through pivot pin bore 86, and assembly pin holes 80 are in alignment. Crankpin 24, FIG. 3, FIG. 10, FIGS. 13–15, protrudes into shaped cavity 52 in engagement plate 50. The control plate 28, shown in FIGS. 6 and 7, is mounted within shaped cavity 52 in the engagement plate 50 so that the end of crankpin 24 passes through crankpin bore 32 of the control plate 28, and is flush with its surface when the control plate 28 is resting upon the top surface of the front plate 46. The cover plate 68, FIG. 9, FIG. 11, is mounted upon the engagement plate 50 so that the blade pivot pin 22 passes through blade pivot pin bore 86, and finger stem 30 on control plate 28 passes through finger stem hole 70 in the cover plate 68, FIG. 7, FIG. 11, and the assembly pin holes 80 are aligned. Assembly pins 82 are passed into the assembly pin holes 80 to complete the structural assembly, shown in sectional view in FIG. 12 and in top view FIG. 11. Decorative scales and bolsters may be added to cover the sides of the handle, if desired—and for this reason the blade pivot pin 22 and the assembly pins 82 may be left to extend past the surfaces of cover plate 68 and back plate 40 to protrude through or partially through the scales or bolsters to assist in their attachment.

It is understood that instead of assembly pins 82, rivets or screws may be substituted as is conventional in the art. It is also understood that instead of flat plates joined by pins as shown for ease of exposition and understanding, the body of such a knife could be formed from a larger casting or bar. In particular, spine 42, front plate 46, and engagement plate 50 form a unit that could be cast or machined in one piece. Alternatively, control plate 28, shown as one piece may be assembled of three parts as will be obvious to those skilled in the art.

Parts of such a knife are made of a strong rigid material, ordinarily steel or stainless steel, high strength low weight alloys such as titanium and aluminum, ceramic or plastic, but not limited to these materials.

It will be noted that blade 20 has a blade stop notch 26 as shown on FIG. 2 and that spine 42, FIG. 8, has spine stop notch 44 in a position to engage blade stop notch 26 when the blade is open. Also to be noted is that one end of the shaped cavity 52 in engagement plate 50, hereinafter referred to as the north end, is shaped to allow passage of the crankpin end of control plate 28 as crankpin 24 moves in crankpin slot 48 in front plate 46, as shown in FIGS. 5, 10, 13, 14. Also that the south end of shaped cavity 52 is shaped with bypass slot 56 so that the south end of control plate 28 can enter it as crankpin 24 rotates, FIG. 13. At the north end of bypass slot 56 is engagement spur 60 and engagement ramp 62. On the west guide surface 58 of shaped cavity 52 stop ridge 64 protrudes, FIG. 4. Control plate 28 is formed with a toe 34, a cam surface 36 and a heel 38 as shown in FIG. 6.

I will explain the engagement plate and control plate geometry in detail after I explain the operation of the invention.

FOLDING KNIFE-OPERATION

FIG. 13 shows the knife of this invention in the half open position. The heel 38 of control plate 28 contacts the east guide surface 54 of shaped cavity 52 in engagement plate 50, the parts of which are shown separately in FIG. 5 and FIG. 6. The toe 34 of control plate 28 contacts the southern portion of the west guide surface, 58 of bypass slot 56 in shaped cavity 52. The shaped cavity 52, and bypass slot portion thereof and the various guide and control surfaces thereon are illustrated also in FIG. 5. As finger pressure is transmitted to finger stem 30 of control plate 28 in a westerly and northerly direction, crankpin 24 is forced to rotate on the center provided by the blade pivot pin 22: Since the south end of the control plate 28 cannot yield in a westerly direction, the west guide surface, 58 of the bypass slot 56, which constitutes a fulcrum for the control plate 28 and also a sliding ramp that the control plate 28 is forced to climb in a northerly direction, the blade 20 consequently is forced to rotate clockwise into the open position since it is pinned to move freely on the blade pivot pin 22 and is attached to crankpin 24, which is offset from the center of blade rotation, the blade pivot pin 22.

Thus, in this region of its cycle, control plate 28 functions, in the first instance, as a swinging lever. The toe 34 of the control plate 28 constitutes the fulcrum; the finger stem 30 constitutes the locus of applied force westwards; and the crankpin 24, upon which the control plate 28 itself swings, constitutes the load.

In the second instance, as the cycle progresses, and the crankpin 24 reaches the limit of westward movement permitted by its own arc, the direction of finger pressure upon the finger stem 30 is changed to a northerly direction. Consequently the applied force is now substantially parallel to, rather than perpendicular to, the walls of the bypass slot 56. The control plate 28 now functions as a rod to push the crankpin 24 in a northerly direction; still, of course, swinging upon said crankpin. Thus, I define the function of the control plate 28, in regard to this movement, as a swinging rod.

Both the swinging lever and swinging rod functions of the control plate 28 are further elaborated in other regions of the operating cycle.

FIG. 14 shows the blade in the fully extended position. The blade stop notch 26 on the blade 20, shown in FIG. 2, is engaged with spine stop notch 44 on the spine 42, shown in FIG. 8. This engagement limits the extent of blade rotation in the clockwise or opening direction. The toe 34 of the control plate 28 can now pass the top of bypass slot 56 and move westward, past the engagement spur 60 formed by the intersection of the west guide surface 58 of the bypass slot 56 and the engagement ramp 62, shown in FIG. 5.

The south or free end of the control plate 28 forms a cam surface 36, shown in FIG. 6. The distance from the center of the crankpin bore 32 of the control plate 28 to the heel 38 of the cam surface 36 is greater than from the same center to the toe 34. Consequently the toe 34 will pass engagement spur 60 and enter the engagement ramp 62 only a short distance before the cam surface 36 of the control plate 28 runs out of clearance and begins to meet resistance. As, has been said, the blade can rotate no further, running clearances will begin to be taken up by further westward progress of the control plate 28.

Once this mechanical slack has been taken up, additional westward finger pressure on finger stem 30 will result in control plate 28 wedging firmly in place between the engagement spur 60 and the crankpin 24, effectively placing the structural system of the knife under a static elastic stress, thus locking and tightening the blade against reverse rotation.

The north-south component of this stress will greatly exceed the east-west component. Thus the control plate 28 will remain securely on the engagement spur 60 and in engagement ramp 62 until reverse pressure is applied by the finger. This locked and tightened condition of the control plate 28 and blade is shown in FIG. 15.

It should be noted that once the toe 34 of the control plate 28 has passed the engagement spur 60, and substantially entered the engagement ramp 62, the blade 20 cannot be forced to reverse its motion, since the wall of the engagement ramp 62 presents a mechanical block to movement of the control plate 28 in a southerly direction: i.e. the direction which counter-rotation of the crankpin 24 would push it. This is true whether or not the cam surface 36 of the control plate 28 has passed the engagement spur 60 far enough to tighten the engagement. Consequently, it is seen that the control plate 28 acts progressively in its locking function: first it functions as a pawl to engage the engagement spur 60 and mechanically block reverse motion of the blade 20; and second, it tightens that engagement by the progressive lift of the cam surface 36 as the control plate 28 further enters the engagement ramp 62 and impinges upon the surface of the engagement spur 60.

As reverse finger pressure is applied to unlock the blade 20 from its opened and locked position, FIG. 15, the control plate 28 will leave the engagement ramp 62, and, released from contact with the engagement spur 60, the heel 38 of the control plate 28 will strike the east guide surface 54 of the shaped cavity 52 of the engagement plate 50. This opened but unlocked condition is illustrated in FIG. 14.

Further pressure on the finger stem 30 of the control plate 28 in a southerly and easterly direction will force the heel 38 to follow the east guide surface 54 southward into the bypass slot 56, the condition illustrated in FIG. 13, thence northward again, as the crankpin 24 passes its southernmost point, FIG. 13, FIG. 11.

In the blade closing region of movement in the operating cycle, the control plate 28 further functions; initially as a swinging rod to pull the crankpin 24 in a southerly direction, the south end of the control plate 28 passing into the bypass slot 56, as in FIG. 13. The control plate 28 next functions briefly as a swinging lever, the heel 38 fulcrumed this time on the east guide surface 54 of the shaped cavity 52 in order to move the crankpin 24 in an easterly direction. Finally, the control plate 28 functions again as a swinging rod to push the crankpin northerly to complete the blade closing movement.

As the blade 20 reaches its fully closed position, shown in FIG. 11, the tang portion of the blade 20 adjacent to the crankpin 24 will contact the northern portion of the spine 42 and the blade 20 will be blocked against further rotation closed. The toe 34 of the control plate 28 can now enter engagement ramp 62 past engagement spur 60, but now at a different angle due to the change of position of crankpin 24 relative to the location of the blade pivot pin 22. This may be seen by comparing the position of the crankpin 24 relative to the blade pivot pin 22 shown in FIG. 10, with that shown in FIG. 15.

However, the distance from the center of crankpin bore 32 on the control plate 28 to the point of contact on engagement spur 60 is the same as in the fully open position of the blade 20, as will be shown below.

Therefore, finger pressure on finger stem 30 in a westerly direction will now lock the blade into the closed and locked condition in the same manner as described for the open and locked condition. This condition is shown in FIG. 10.

Overtravel stop ridge 64 on the engagement plate 50, FIG. 5, is shaped to contact the toe 34 of control plate 28, thus preventing the heel 38 from passing the engagement spur 60 into the engagement ramp 62, under any circumstance, when the blade is closed. This assures that the control plate 28 cannot become jammed by an incident causing overtravel. The closed and locked position of the blade is shown in FIG. 10.

When it is desired to unlock the blade 20, as shown in FIG. 10, an eastward pressure of the finger on finger stem 30 will disengage the cam surface 36 of the control plate 28 from the engagement spur 60, and the heel 38 will again strike the east guide surface 54 of the shaped cavity 52 of the engagement plate 50, as shown in FIG. 11.

Southward finger pressure on finger stem 30 will force the control plate 28 southward into the bypass slot 56 as guided by the contact of the heel 38 of the control plate 28 with the east guide surface 54 of the shaped cavity 52.

In this region of its operating cycle, the control plate 28 again functions as a swinging rod to pull the crankpin 24 in a southerly direction. As the control plate 28 reaches the southernmost extension of its movement in the bypass slot 56, finger pressure direction will cause the transfer of contact of the control plate 28 from the heel 38 to the toe 34, contacting the west guide surface 58. In this configuration, the toe 34 becomes a fulcrum for the further functioning of the control plate 28 as a swinging lever, as described before.

In summary of the operating cycle, the control pate 28, attached to the offset blade crankpin 24 and impinging on the various wall surfaces of the shaped cavity 52, functions sequentially as a swinging rod, swinging lever, pawl, and cam, under the direction finger pressure of the user, transmitted through the finger stem 30. The shaped cavity 52, with its various guide surfaces; the east guide surface 54, bypass slot 56, west guide surface 58, engagement spur 60, engagement ramp 62, and stop ridge 64, function to guide, limit and support the movement of control plate 28 and to hold and support the control plate 28 in the locked and tightened positions.

GEOMETRY OF SHAPED CAVITY

Many geometrical configurations are possible but the following arrangement is preferred:

An longitudinal axis passing from the point of the fully opened blade and through the center of the blade pivot bores 84, 86 is described here as the north-south line.

The total desired angular blade movement between open and closed is equally distributed on either side of the north-south line to locate the crankpin bore 88 on its desired radius on the tang of the blade 20.

In the same manner the locations of the ends of the arcurate crankpin slot 48 may be determined on the front plate 46, and the crankpin centers located on the engagement plate 50.

Arcs of equal radii swung from the crankpin centers at open and closed positions will meet at the north-south line and define the point of the engagement spur 60. The arc centered on the open position will define the contour of the engagement ramp 62.

An arc centered on the engagement spur 60 point and swung northward from the western terminus of the engagement ramp 62 will intersect the arc swung previously, centered on the closed position of the crankpin center, and will define the overtravel stop ridge 64 as well as the contour of the west guide surface 58 between the engagement ramp 62 and the stop ridge 64, and its corresponding contour of the toe 34 of the control plate 28.

Since the engagement spur 60 is equally distant from the crankpin 24 at either extension of the blade 20, the cam surface 36 of the control plate 28 will engage the engagement spur 60 equally at either position of the crankpin 24, despite different angles of engagement.

GEOMETRY OF CAM

Many workable cam contours are possible, however an exponential rate of lift is preferred.

Maximum total cam lift will depend on materials, fit and finish. The total lift necessary for a particular application may be found experimentally by trying arcs of increasing radius which pass through a fixed point on the cam toe 34, which will just clear the engagement spur 60 and enter the engagement ramp 62, which radii are centered near the crankpin bore 32 and on an radial line between the center of that bore and the heel 38.

Once a suitable lift value has been established in this manner, the rate of lift may be modified by employing various arc curvatures centered on the perpendicular bisector of the arc which initially established the desired total lift value.

Thus, the reader will see that the folding knife of the present invention provides considerable advantages of strength, simplicity, mechanical integrity, convenience, safety and workability.

While my above description contains many specifications, the reader should not construe these as limitations on the scope of the invention, but merely as exemplifications of preferred embodiments thereof. Those skilled in the art will envision many other possible variations are within its scope. For example, endless variations on blade and handle shapes are possible with knives, to fit a particular or general use envisioned.

Among other hand tools, punches, picks, awls, scribers, files, hooks, combs, will come readily to mind. Also optical devices such as magnifiers; sampling devices such as spoons, cups, spatulas; sensing and measuring devices such as feeler gauges, pH meters, or thermometers, conductivity meters, etc.

Although working or structural parts of knives have been traditionally made of steel and heavy alloys, other materials such as ceramics, light alloys and plastics are coming into use. An ultralight and serviceable defensive weapon of fiber-reinforced plastic could unquestionably be manufactured according to the invention.

Although the control plate has been shown here configured to bear a compressive load, and to engage with a single spur, other configurations are possible: tensile loading of the control plate, which forms a hook at the distal end and engages with a notch in the cavity or a bar, traversing the cavity, which is supported by the side plates; multiple engagement points; engagement on the east rather than west sides.

Likewise many devices for locking the control plate in a more permanent fashion can be envisioned: bars or latches to pin the control plate or prevent it from exiting the engagement ramp could be applied from numerous directions.

As an optical adjunct or social prop the invention would make a sublimely superior monocular lorgnette.

As a novelty item, the invention could house a humorous or impudent icon for display at parties or athletic events.

Accordingly, the scope of the invention should be determined, not by the embodiments which have been illustrated here, but by the appended claims and their legal equivalents.

I claim:

1. A folding hand tool comprising:

an elongated handle;

a working element pivotally mounted to one end of said handle, said handle supporting said working element in an extended position and enclosing said working element in a folded position;

said handle having engagement means and control plate means connected to said working element;

said engagement means cooperating with said control plate means to move and lock said working element in both extended and folded positions;

said control plate means comprising a control rod having two ends between which is a protruding stem upon which pressure is directly applied:

said control rod comprising a crankpin at one end connected to said working element and a cam surface at the other end; a pawl being provided next to one end of said cam surface;

said engagement means comprising an arcuate slot for slidably receiving said crankpin and an elongated shaped cavity for receiving said control rod with one end of said shaped cavity being adjacent said arcuate slot, said shaped cavity having two opposed guide surfaces; an engagement ramp located at the other end of said shaped cavity extending from one surface toward the other surface of said opposed guide surfaces and situated between said two opposed guide surfaces forming an engagement spur;

wherein said working element is locked in the extended position when the crankpin is at one end of said slot and said pawl is in engagement with said spur, and said working element is locked in the folded position when said crankpin is at the other end of said slot and said pawl is in engagement with said spur.

* * * * *